US005692397A

United States Patent [19]

Higginbotham

[11] Patent Number: 5,692,397

[45] Date of Patent: Dec. 2, 1997

[54] AIR SEPARATION

[75] Inventor: Paul Higginbotham, Guildford, England

[73] Assignee: The BOC Group plc, Windlesham Surrey, England

[21] Appl. No.: 733,827

[22] Filed: Oct. 18, 1996

[30] Foreign Application Priority Data

Oct. 24, 1995 [GB] United Kingdom ..... 9521782

[51] Int. Cl.[6] ..... F25J 3/00

[52] U.S. Cl. ..... 62/646; 62/654

[58] Field of Search ..... 62/643, 646, 654

[56] References Cited

U.S. PATENT DOCUMENTS

| | | | |
|---|---|---|---|
| 5,209,070 | 5/1993 | Darrendeau | 62/646 |
| 5,263,327 | 11/1993 | Drnevich et al. | 62/646 |
| 5,400,600 | 3/1995 | Grenier | 62/646 |
| 5,438,835 | 8/1995 | Rathbone | 62/646 |

*Primary Examiner*—Ronald C. Capossel

*Attorney, Agent, or Firm*—David M. Rosenblum; Salvatore P. Pace

[57] ABSTRACT

Air is separated in a higher pressure rectification column into a bottom fraction of oxygen-enriched liquid air and a top fraction of nitrogen. The column has a first inlet for a first vaporous air stream at a first pressure communicating with an expansion turbine. A first condenser-reboiler for condensing a second vaporous air stream at a second pressure greater than the first pressure has an inlet communicating with a compressor. The condensate flows through an expansion valve into the higher pressure rectification column. A stream of oxygen-enriched liquid is withdrawn from the bottom of the column and is introduced into a lower pressure rectification column in which an impure oxygen fraction is separated. A second condenser-reboiler places the top of the higher pressure rectification column in heat exchange relationship with an intermediate region of the column. Reboil for the bottom of the column is provided by the first condenser-reboiler. An impure oxygen product is withdrawn from the column. Less power is consumed than in comparable known processes.

12 Claims, 3 Drawing Sheets

AIR SEPARATION

BACKGROUND OF THE INVENTION

This invention relates to a method and apparatus for separating air.

In a conventional, widely used, process for separating air, a double rectification column comprising a higher pressure rectification column and a lower pressure rectification column is employed. The top of the higher pressure rectification column is thermally linked to the bottom of the lower pressure rectification column by a condenser-reboiler. Nitrogen vapour separated in the higher pressure rectification column is thus able to reboil a liquid oxygen fraction separated in the lower pressure rectification column, the nitrogen being condensed. This thermal linking at the top of the higher pressure rectification column to the bottom of the lower pressure rectification column effectively places a constraint on the pressure at which the higher pressure rectification column be operated. Typically, it is desirable to operate the bottom of the lower pressure rectification column at a pressure between 1 and 1.5 bar absolute. In consequence, it is necessary to employ a pressure in the order of 5 to 6 bar at the top of the higher pressure rectification column.

It is also known that the operating pressure of the higher pressure rectification column can be reduced, with a resultant saving in power, by employing a stream of air to reboil the lower pressure rectification column and arranging for the nitrogen condenser to be cooled by liquid from an intermediate region of the lower pressure rectification column. One such process is illustrated in EP-A-0 538 117. In this process, an oxygen reboiler at the bottom of the lower pressure rectification column is heated by a stream of air taken from the same source as that which supplies the higher pressure rectification column with air. Thus, the operating pressure of the higher pressure rectification column is fixed by the pressure at which the air stream that reboils the lower pressure rectification column needs to be supplied. As a result, the higher pressure rectification column is operated at a higher pressure than is otherwise possible and hence the power consumption of the method, particularly when it is desired to produce an impure oxygen product at elevated pressure, is undesirably high.

SUMMARY OF THE INVENTION

It is an aim of the present invention to provide a method and apparatus which are able to produce a pressurised oxygen product at a lower specific power consumption than in the process illustrated in EP-A-0 538 117.

According to the present invention there is provided an air separation method comprising; introducing a first vaporous air stream at a first pressure into a higher pressure rectification column; partially or totally condensing at a second pressure a second vaporous air stream by indirect heat exchange; expanding the partially or totally condensed second air stream, and introducing at least a part of the expanded second air stream into the higher pressure rectification column; forming in the higher pressure rectification column a bottom fraction of oxygen-enriched liquid air and a top fraction of nitrogen vapour; introducing a stream of the oxygen-enriched liquid air into a lower pressure rectification column and separating therein an impure oxygen fraction; withdrawing a stream of the impure liquid oxygen fraction from the lower pressure rectification column; wherein the condensing second air stream reboils a bottom liquid fraction of the lower pressure rectification column; the top of the higher pressure rectification exchanges heat with an intermediate region of the lower pressure rectification column, the second pressure is greater than the first pressure, and the first and second streams are derived from different machine stages at different pressures from one another.

The invention also provides apparatus for separating air comprising a higher pressure rectification column for separating air into a bottom fraction of oxygen-enriched liquid air and a top fraction of nitrogen, having a first inlet for a first vaporous air stream at a first pressure communicating with a first machine stage; a first condenser-reboiler for partially or totally condensing a second vaporous air stream at a second pressure greater than the first pressure by indirect heat exchange, the first condenser-reboiler having condensing passages communicating at their inlet ends with a second machine stage operable at a different pressure from the first machine stage; a first expansion device communicating with the condensing passages and exhausting into the higher pressure rectification column; an oxygen enriched liquid air outlet from the higher pressure rectification column for a stream of the bottom fraction of oxygen-enriched liquid air communicating with an oxygen enriched liquid air inlet to a lower pressure rectification column for separating an impure oxygen fraction from said stream of oxygen-enriched liquid air; an impure oxygen outlet for impure oxygen product from the lower pressure rectification column; and a second condenser-reboiler placing the top of the higher pressure rectification column in heat exchange relationship with an intermediate region of the lower pressure rectification column, wherein the first condenser-reboiler has boiling passages in communication with the bottom of the lower pressure rectification column for boiling a bottom fraction by indirect heat exchange with the condensing second stream of air.

The method and apparatus according to the invention enable an oxygen product to be produced with a particularly low specific power consumption in comparison with a method according to EP-A-0 538 117. This improvement arises from an ability to operate the higher pressure rectification column at a lower pressure than the condensing passages in the first condenser-reboiler. This feature of the method according to the invention has the effect of reducing the pressure at which the first stream of air needs to be formed. Another advantage of the method and apparatus according to the invention is that a relatively pure oxygen product can be separated in addition to the impure oxygen product. For a given oxygen recovery, it is possible to produce a greater proportion of the total oxygen product in relatively pure state in comparison with the method according to EP-A-0 538 117.

The term "machine", as used herein, embraces both compressors and expansion turbines. By the term "different machine stages" is meant either different machines or different stages of the same machine. If, as is typical, either of the first and second vaporous air streams flow through a plurality of machine stages upstream of their introduction column or the condenser in which the second stream is partially or totally condensed, then that stream shall be deemed to be derived from the more or most downstream of the machine stages.

If both the first and second vaporous air streams are derived from different compressors or compression stages, the method according to the present invention preferably further comprises expanding a third stream of compressed air with the performance of external work and introducing at least part of the expanded third stream of air preferably into the higher pressure rectification column, or alternatively into the lower pressure rectification column. Accordingly, the apparatus according to the invention preferably includes a second expansion device for the third stream of compressed air exhausting into the higher pressure rectification column or alternatively with the lower pressure rectification column. The second expansion device is preferably an expansion turbine.

Expansion of the air with the performance of external work to the operating pressure of the higher pressure rectification column generally makes it possible to operate the higher pressure rectification column at a lower pressure than if the air that is expanded with the performance of external work is introduced into the lower pressure rectification column. It also makes possible production of higher purity product at a greater rate than if the expanded air is introduced into the lower pressure rectification column. However, the latter alternative makes possible the recovery of a greater amount of work by virtue of the greater pressure difference between the outlet pressure of the expansion turbine and its inlet pressure.

Unless it is desired to produce a relatively pure oxygen product in addition to the impure oxygen product, the bottom fraction formed in the lower pressure rectification column is preferably the said impure oxygen fraction. If on the other hand a relatively pure oxygen product is produced, the bottom fraction is preferably the relatively pure oxygen. The impure and relatively pure oxygen products may each be withdrawn in vapour state and/or in liquid state from the lower pressure rectification column. If withdrawn in liquid state, some or all may be warmed by indirect heat exchange to form a high pressure gaseous product.

In addition, some of the liquid oxygen may be kept as a liquid product.

The method and apparatus according to the present invention are particularly suited to the production of an impure oxygen product having an oxygen concentration in the range of 90 to 96% by volume. If a relatively pure oxygen product is produced in addition to the impure one, its purity is preferably at least 99% by volume.

BRIEF DESCRIPTION OF THE DRAWING

Methods and apparatus according to the present invention will now be described by way of example with reference to the accompanying drawings, in which.

The drawings are not to scale.

Figure 1:
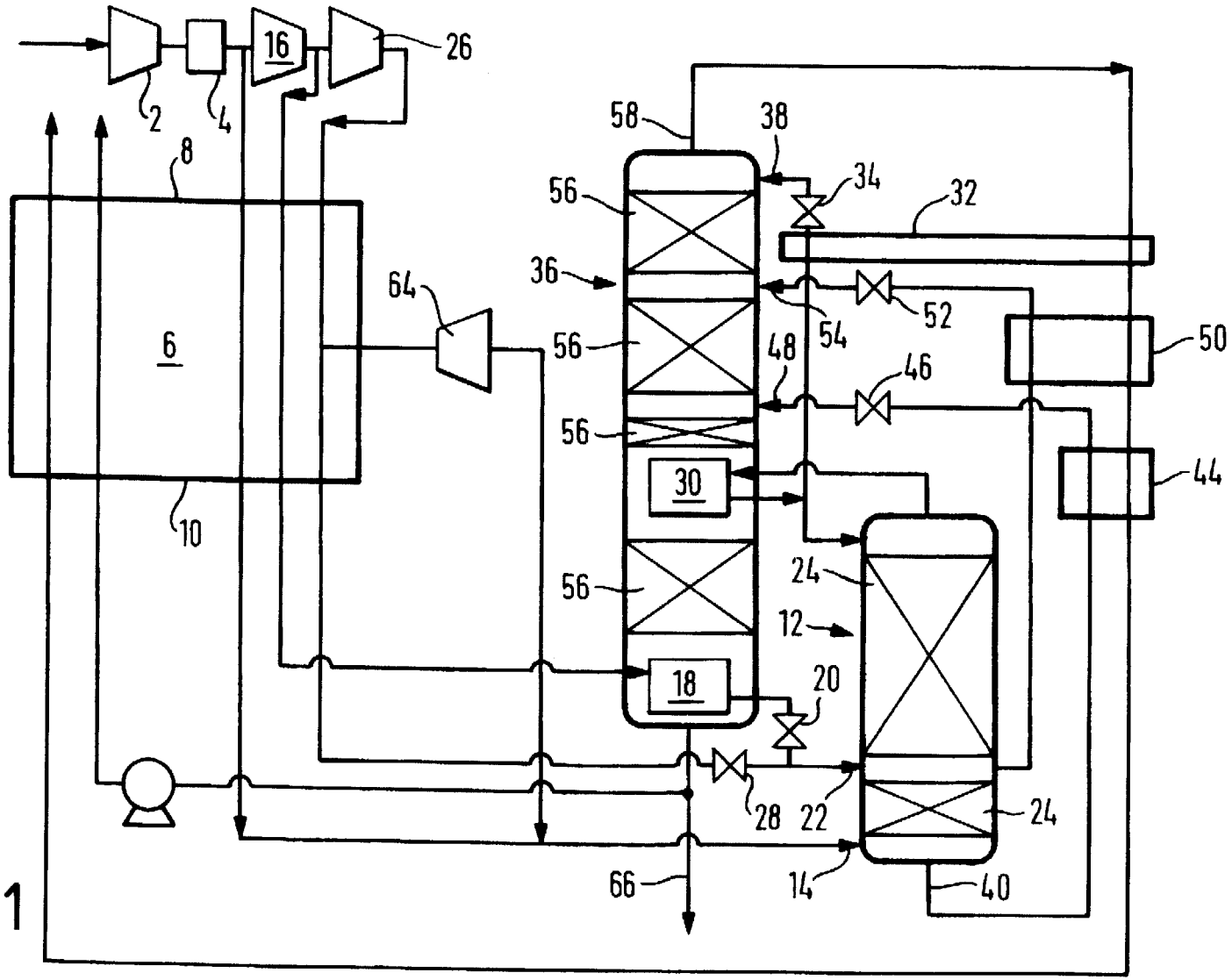
FIG. 1 is a schematic flow diagram of a first air separation plant.
Figure 2:
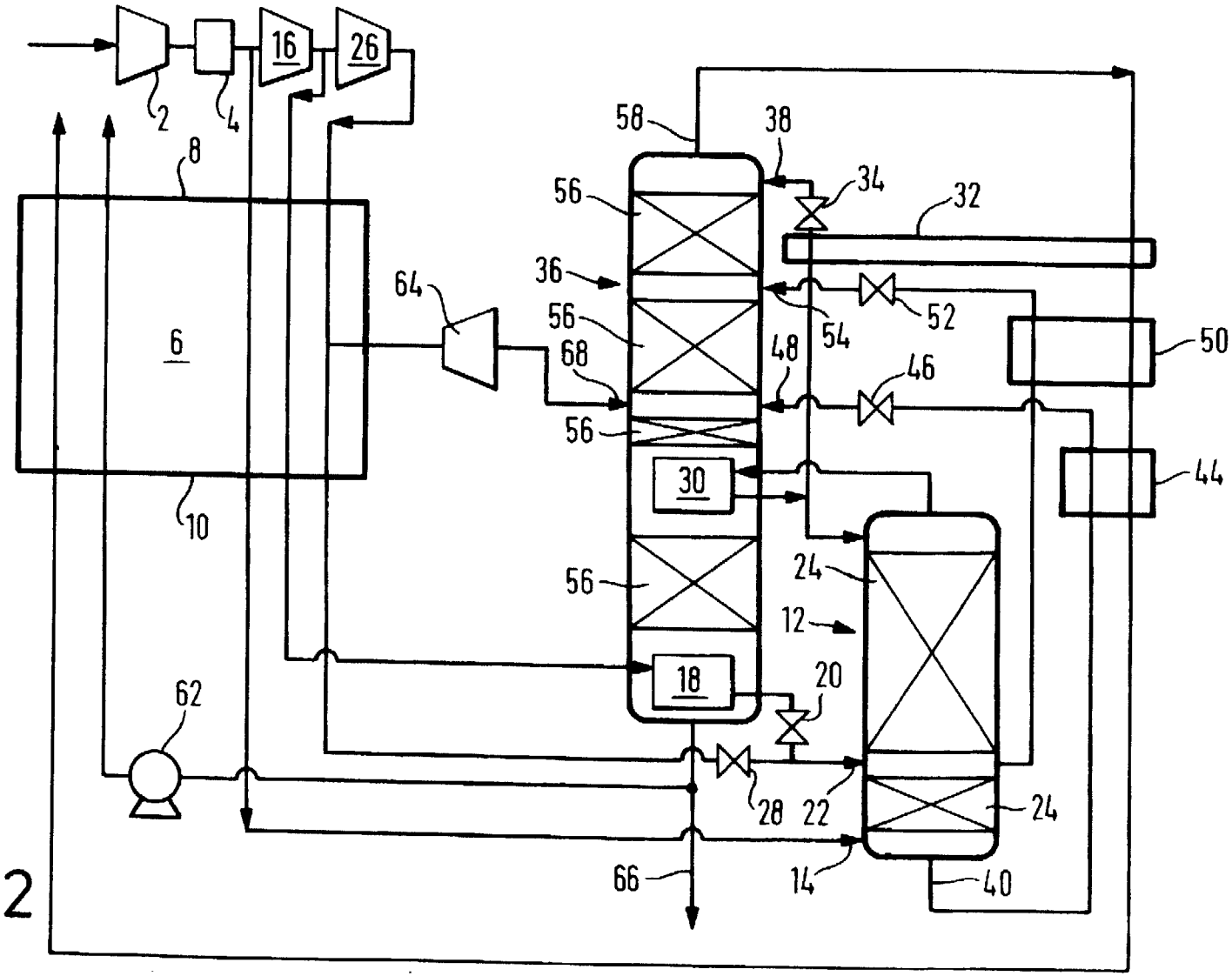
FIG. 2 is a schematic flow diagram of a second air separation plant.
Figure 3:
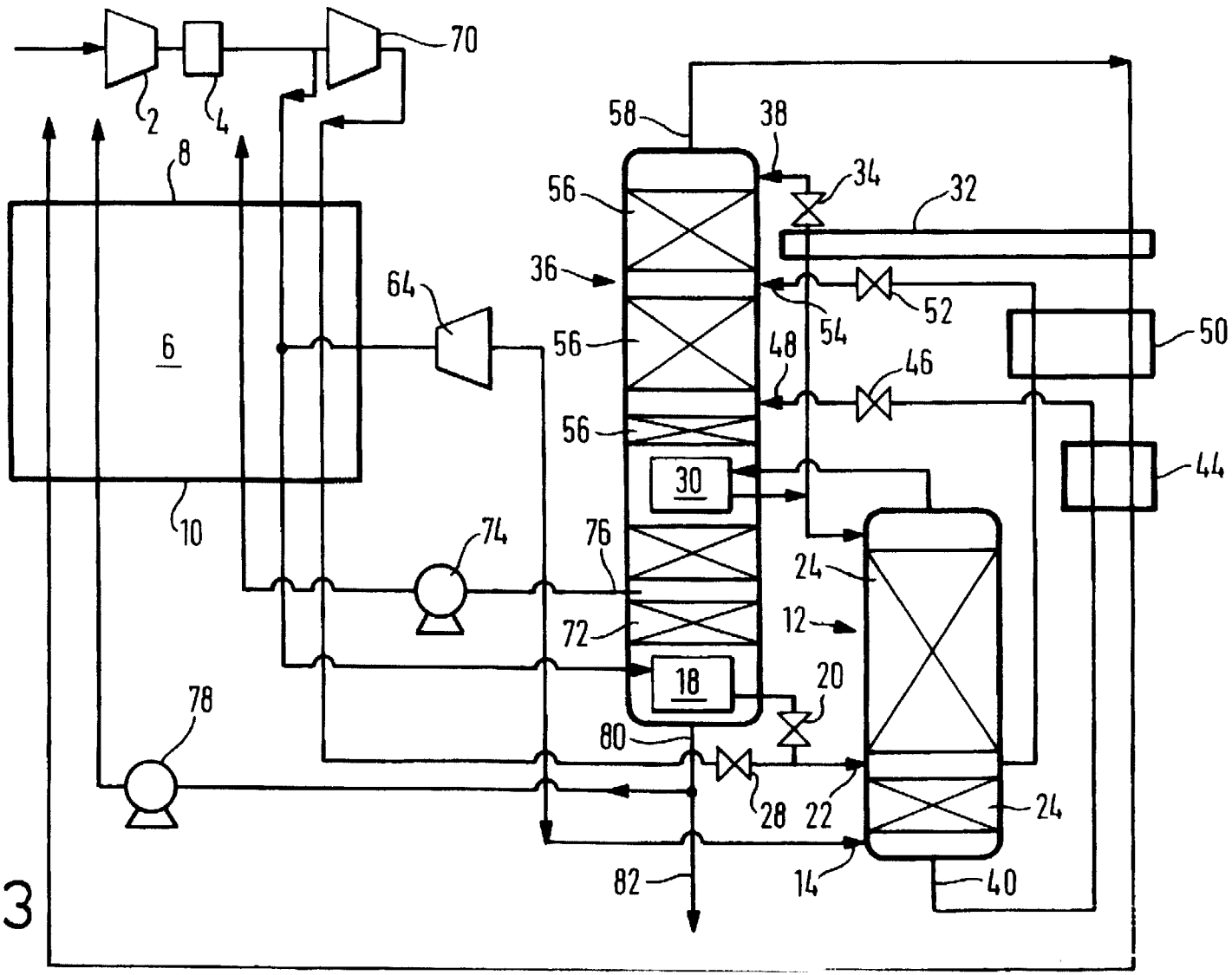
FIG. 3 is a schematic flow diagram of a third air separation plant.

Parts in FIG. 2 and FIG. 3 that are like parts in FIG. 1 are identified by the same reference numerals as in FIG. 1.

DETAILED DESCRIPTION

Referring to FIG. 1 of the drawings, a stream of air is compressed in a compressor 2 to a chosen elevated pressure. The compressed air has heat of compression removed therefrom in an aftercooler (not shown) either by direct evaporative contact with water or by indirect heat exchange with water. The resulting cooled air is supplied to a purification unit 4 which is effective to remove water vapour, carbon dioxide and other impurities of relatively low volatility from the air. Typically, the air is purified in the unit 4 by adsorption. The construction and operation of adsorptive air purifiers are well known in the art and need not be described further herein. The first air stream flows through a main heat exchanger 6 from its warm end 8 to its cold end 10 and is thereby cooled to its saturation temperature or a temperature slightly thereabove. The thus cooled first stream of air is introduced into a higher pressure rectification column 12 through an inlet 14 at its bottom without passing through any expansion device.

The remainder of the purified air flow is further compressed in an upstream booster-compressor 16 and the resulting further compressed flow of air is cooled to approximately ambient temperature in an after-cooler (not shown) in which the cooling is typically effected by indirect heat exchange with a flow of water. A second stream of compressed air is taken from the cooled, further compressed, flow of air and flows through the main heat exchanger 6 from its warm end 8 to its cold end 10, thereby being cooled to approximately its saturation temperature. The thus cooled second air stream flows from the cold end 10 of the main heat exchanger 6 to a condenser-reboiler 18 in which it is at least partially condensed by indirect heat exchange with a boiling liquid. The resulting flow of at least partially condensed air passes through a throttling valve 20 which is effective to reduce its pressure to approximately that of the higher pressure rectification column 12. Downstream of the valve 20 this flow is introduced into an intermediate region of the higher pressure rectification column 12 through an inlet 22. The inlet 22 is situated at a level below and above which there are liquid-vapour contact devices 24. These devices may take the form of distillation trays, for example sieve trays, or a structured or random packing.

The remainder of the after-cooled air from the upstream booster-compressor 16 flows to a downstream booster-compressor 26 in which it is further compressed. The air stream leaving the downstream booster-compressor 26 has heat of compression removed therefrom by passage through an after-cooler (not shown) in which it is cooled to approximately ambient temperature. The resulting cooled stream of air from the downstream booster-compressor 26 flows as a third compressed air stream through the main heat exchanger 6 from its warm end 8 to its cold end 10. The outlet pressure of the downstream booster-compressor 26 is selected such that the third compressed air stream is condensed in the main heat exchanger 6. Alternatively, the booster-compressor 26 may raise the pressure of the third compressed air stream to a level at which it becomes a supercritical fluid. Downstream of the cold end 10 of the main heat exchanger 6 the third compressed air stream flows in either condensed or supercritical state through a throttling valve 28 which reduces the pressure of the flow to approximately the operating pressure of the higher pressure rectification column 12. If the air enters the valve 28 in supercritical state, it leaves the valve essentially in liquid state. Downstream of the throttling valve 28, the third air stream is mixed in liquid state with the flow from the throttling valve 20 upstream of its introduction into the lower pressure rectification column 12 through the inlet 22.

The streams of air that are introduced into higher pressure rectification 12 have nitrogen separated from them therein. A nitrogen fraction is obtained at the top of the higher pressure rectification column 12. There is a flow of nitrogen out of the top of the higher pressure rectification column 12 into another condenser-reboiler 30 in which it is condensed by indirect heat exchange with a boiling liquid. The resulting flow of condensed nitrogen is divided into two parts. One part of the flow is returned to the top of the higher pressure rectification column 12 and provides reflux for the column 12. The other part is sub-cooled by passage through a heat exchanger 32, flows through a throttling valve 34 which is effective to reduce its pressure to the operating pressure at the top of a lower pressure rectification column 36 and is introduced into the top of the column 36 through an inlet 38. The liquid nitrogen introduced into the top of the column 36 provides reflux for that column.

An oxygen-enriched liquid fraction is obtained at the bottom of the higher pressure rectification column 12. A stream of oxygen-enriched liquid flows from the bottom of the higher pressure rectification column 12 through an outlet 40 and is sub-cooled by passage through a heat exchanger 44. The resulting sub-cooled oxygen-enriched liquid is passed through a throttling valve 46 so as to reduce its pressure at approximately that of the lower pressure rectification column 36 and is introduced into an intermediate region of the column 36 through an inlet 48. The oxygen-enriched liquid stream thus forms a feed stream to the column 36 for separation therein into nitrogen and impure oxygen fractions. A further feed stream for the lower pressure rectification column 36 is taken from the same level of the higher pressure rectification column 12 as that at which the inlet 22 is situated and is sub-cooled by passage through a heat exchanger 50. The resulting sub-cooled liquid air stream flow through a throttling valve 52 and is introduced into the lower pressure rectification column 36 through an inlet 54 at a level below that of the inlet 38 but above that of the inlet 48.

Reboil, that is an upward flow of vapour, for the lower pressure rectification column 36 is created by reboiling part of an impure liquid oxygen fraction at the bottom of the column 36. The reboiling is effected in the boiling passages (not shown) of the condenser-reboiler 18. The condenser-reboiler 18 is thus typically situated in the sump of the lower pressure rectification column 36. The flow of vapour up the column 36 is enhanced by employing the second condenser-reboiler 30 to boil liquid at an intermediate level of the lower pressure rectification column 36. Typically, this level is below that of the inlet 48 but above a bottom section of liquid-vapour devices 56 in the column 36. The liquid-vapour contact devices 56 typically take the form of structured or random packing. Typically, there are four sections of packing 56 in lower pressure rectification column 36. In addition to the previously mentioned bottom section, there is a second section between the condenser-reboiler 30 and the level of the inlet 48; a third section between the level of the inlet 48 and that of the inlet 54, and a fourth section between the inlet 54 and the top of the column 36.

A stream of nitrogen withdrawn from the top of the lower pressure rectification column 36 through an outlet 58 and flows in sequence through the heat exchangers 32, 50, 44 and 6. An impure liquid oxygen product is withdrawn from the bottom of the lower pressure rectification column 36 through an outlet 60 by means of a pump 62 which raises its pressure to a chosen value. The pressurised liquid oxygen flows through the main heat exchanger 6 cocurrently with the nitrogen stream from its cold end 10 to its warm end 8. A pressurised oxygen product at approximately ambient temperature is thereby produced. The impure oxygen product typically contains in the order of 5% by volume of impurities. It is therefore unnecessary to perform any separation of argon from oxygen in the lower pressure rectification column 36 with the consequence that the height of the column 36 is markedly less than if a pure oxygen product is required.

The outlet pressure of the booster-compressor 26 is selected such that there is a relatively close match between the temperature-enthalpy profile of the vaporising oxygen stream and that of the third compressed air stream in the heat exchanger 6. In order to provide refrigeration for the plant, a part of the third air stream is withdrawn at a temperature of approximately 150K from an intermediate region of the heat exchanger 6 and is expanded with the performance of external work in an expansion turbine 64. The resultant expanded air is mixed with the first air stream downstream of the cold end 10 of the main heat exchanger 6 but upstream of the inlet 14. The air expanded in the turbine 64 is thus introduced into the higher pressure rectification column 12. If desired, the work performed by the turbine 64 may be used in driving one or other of the booster-compressors 16 and 26 and accordingly the rotor (not shown) of the turbine 64 may be mounted on the same shaft as that of the compressor 16 or 26.

If desired, a proportion of the impure oxygen product of the plant shown in FIG. 1 may be sent via a conduit 66 to storage (not shown).

In a typical example of the operation of the plant shown in FIG. 1 the higher pressure rectification column operates at a pressure of about 3 bar at its top and lower pressure rectification column at a pressure of about 1.3 bar at its top. If an impure oxygen product at a pressure of 6 bar is required, the downstream booster-compressor 26 preferably has an outlet pressure of 15 bar. It can be appreciated that in this example a higher pressure rectification column is operating at a particularly low pressure having regard to previously known air separation plant.

The air separation plant shown in FIG. 2 is substantially the same as that shown in FIG. 1 except that the expansion turbine 64 instead of communicating with the higher pressure rectification column 12 communicates with an inlet 68 to the lower pressure rectification column 36. The inlet 68 is typically located at the same level as the inlet 48. In this example, the higher pressure rectification column is typically operated at a pressure at its top of about 3.6 bar.

Referring now to FIG. 3, in the plant illustrated therein a single booster-compressor 70 takes the place of the booster-compressors 16 and 26 in FIGS. 1 and 2. The second air stream is derived from a flow of purified air that passes from a region downstream of the purification unit 4 and upstream of the booster-compressor 70. The second air stream is cooled by indirect heat exchanger in the main heat exchanger 6 through which it flows from the warm end 8 to the cold end 10. The first air stream is formed by withdrawing part of the second air stream from an intermediate region of the main heat exchanger 6 and expanding it in the turbine 64. The outlet of the turbine 64 communicates with the inlet 14 to the higher pressure rectification column 12 in the same manner as shown in FIG. 1. A third air stream flows from the outlet of the booster-compressor 70 through the main heat exchanger 6 from its warm end 8 to its cold end 10. The third air stream leaves the cold end in liquid state and passes through the valve 28 which is arranged in the same way as shown in FIG. 1.

The lower pressure rectification column 36 in the plant shown in FIG. 3 is designed to produce a 99.5% pure oxygen product in addition to an impure oxygen product typically containing 95% by volume of oxygen. Accordingly the lower pressure rectification column has a bottom liquid-vapour contact section 72 in which oxygen is separated from argon, and the condenser-reboiler 18 is located below this section. A first impure oxygen product is withdrawn by a pump 74 through an outlet 76, pressurised by the pump 74, and is vaporised by passage through the main heat exchanger 6 from its cold end 10 to its warm end 8. A second relatively pure oxygen product is withdrawn through an outlet 80 by a pump 78, is pressurised by the pump 78, and is vaporised by passage through the main heat exchanger 6 from its cold end 10 to its warm end 8. In addition, a relatively pure liquid oxygen product may be withdrawn through an outlet 82.

In other respects, the construction and operation of the plant shown in FIG. 3 are analogous to the plant shown in FIG. 1.

In a typical example of the operation of the plant shown in FIG. 3, the outlet pressure of the main compressor 2 measured at the outlet of the unit 4 is 4.8 bar; the outlet pressure of booster-compressor 70 is 15.2 bar; the outlet pressure of the expansion turbine 64 and hence the pressure at the inlet 14 is 3.0 bar; the pressure of the second air stream at its inlet to the condenser-reboiler 18 is 4.6 bar, the pressure at the top of the higher pressure rectification column 12 is 2.9 bar; the pressure at the bottom of the lower pressure column 36 is 1.5 bar; the pressure at the top of the lower pressure rectification column 36 is 1.4 bar; and both impure and pure gaseous oxygen products are produced at 6 bar. The flow rate of purified air out of the unit 4 is 100000 $Nm^3/hr$. 99.5% (by volume) gaseous oxygen product is produced at a rate of 10400 $Nm^3/hr$, and 95% (by volume) pure gaseous oxygen product is produced at a rate of 9807 $Nm^3/hr$. In addition, 600 $Nm^3/hr$ of a 99.5% pure liquid oxygen product is produced. The oxygen recovery is thus 96.7%. The power consumption was calculated at 7863 KW.

In a comparative example in which the pressure at the inlet 14 to the lower pressure rectification column 12 is operated at the same pressure as the inlet for air to the condenser-reboiler 18, maintaining production of the liquid oxygen product at 600 $Nm^3/hr$ and the 99.5% gaseous oxygen product at 10400 $Nm^3/hr$ resulted in a lower production of 95% oxygen (9715 $Nm^3/hr$) and hence a lower total oxygen recovery (96.5%) at a higher total power consumption (8593 KW).

It can thus be seen that the ability to select the pressure at the bottom of the higher pressure rectification column to be substantially less than that at the inlet for air to the condenser-reboiler 18, arising from the ability to take the first and second air streams from different machine stages at different pressures from one another, gives rise to a substantial decrease in the power consumed per unit volume of oxygen recovered.

The method according to the invention also has an advantage over the "triple reboiler" process according to EP-A-0 660 058. That advantage is that in view of the greater load on the reboiler-condenser in which the second air stream is condensed in the method according to the invention, 99.5% pure oxygen product can be efficiently produced at a greater rate than in the method according to EP-A-0 660 058.

I claim:

1. An air separation method comprising:

introducing a first vaporous air stream at a first pressure into a higher pressure rectification column;

partially or totally condensing at a second pressure a second vaporous air stream by indirect heat exchange;

the second pressure being greater than the first pressure, and the first and second streams being derived from different machine stages at different pressures from one another;

expanding the partially or totally condensed second air stream, introducing at least a part of the expanded second air stream into the higher pressure rectification column;

forming in the higher pressure rectification column a bottom fraction of oxygen-enriched liquid air and a top fraction of nitrogen vapour;

introducing a stream of the oxygen-enriched liquid air into a lower pressure rectification column and separating therein an impure oxygen fraction;

withdrawing a stream of the impure oxygen fraction from the lower pressure rectification column;

reboiling a bottom liquid fraction of the lower pressure rectification column with the condensing second air stream; and exchanging heat between the top of the higher pressure rectification exchanges heat and an intermediate region of the lower pressure rectification column.

2. The method as claimed in claim 1, wherein the first and second vaporous air streams are derived from different compressors or compression stages, a third stream of compressed air is expanded with the performance of external work, and at least part of the expanded third air stream is introduced into the higher pressure rectification column or the lower pressure rectification column.

3. The method as claimed in claim 1, in which the impure oxygen fraction is the bottom fraction formed in the lower pressures rectification column.

4. The method as claimed in claim 1, in which a relatively pure oxygen fraction is formed as the bottom fraction in the lower pressure rectification column, and a relatively pure oxygen product is taken therefrom.

5. The method as claimed in claim 4, in which the relatively pure oxygen product is withdrawn from the lower pressure rectification column, is pressurised, and is vaporised by indirect heat exchange.

6. The method as claimed in claim 4, in which the relatively pure oxygen product is withdrawn from the lower pressure rectification column, is pressurised, and is vaporised by indirect heat exchange with a stream of condensing air.

7. The method as claimed in claim 1, in which the stream of relatively impure oxygen fraction is pressurised and is vaporised by indirect exchange.

8. The method as claimed in claim 7, in which a stream of pressurised air is condensed in indirect heat exchange with vaporising oxygen.

9. An apparatus for separating air comprising:

a higher pressure rectification column for separating air into a bottom fraction of oxygen-enriched liquid air and a top fraction of nitrogen;

said higher pressure rectification column having a first inlet for a first vaporous air stream at a first pressure communicating with a first machine stage;

a first condenser-reboiler for partially or totally condensing a second vaporous air stream at a second pressure greater than the first pressure by indirect heat exchange;

the first condenser-reboiler having condensing passages communicating at their inlet ends with a second machine stage operable at a different pressure from the first machine stage;

a first expansion device communicating with the condensing passages and exhausting into a second inlet to the higher pressure rectification column;

an oxygen enriched liquid air outlet from the higher pressure rectification column for a stream of the bottom fraction of oxygen-enriched liquid air communicating with an oxygen enriched liquid air inlet to a lower pressure rectification column for separating an impure liquid oxygen fraction from said stream of oxygen-enriched liquid air;

an impure oxygen outlet for impure oxygen product from the lower pressure rectification column, and a second condenser-reboiler placing the top of the higher pressure rectification column in heat exchange relationship with an intermediate region of the lower pressure rectification column;

the first condenser-reboiler has boiling passages in communication with the bottom of the lower pressure rectification column for boiling a bottom fraction by indirect heat exchange with the condensing second stream of air.

10. The apparatus as claimed in claim 9, wherein the first and second machine stages are both compressors or different stages of the same compressor.

11. The apparatus as claimed in claim 10, additionally including a second expansion device in the form of an expansion turbine situated so as to expand a third stream of compressed air into the higher pressure or lower pressure rectification column.

12. The apparatus as claimed in claim 9, further comprising an additional outlet from the lower pressure rectification column for a relatively pure oxygen product.

* * * * *